US005697278A

United States Patent [19]

Shun-Yi

[11] Patent Number: 5,697,278

[45] Date of Patent: Dec. 16, 1997

[54] APPARATUS FOR SHAPE CUTTING

[76] Inventor: Wang Shun-Yi, Hsin Sheng N. Rd., Taipei, Taiwan

[21] Appl. No.: 535,939

[22] Filed: Sep. 28, 1995

[51] Int. Cl.[6] ..... B26D 5/10; B26F 1/14

[52] U.S. Cl. ..... 83/588; 83/613; 83/686

[58] Field of Search ..... 83/588, 613, 684, 83/685, 686, 697, 125, 128, 133, 143, 123, 126; 30/358, 360, 364, 361

[56] References Cited

U.S. PATENT DOCUMENTS

| | | | |
|---|---|---|---|
| 1,375,721 | 4/1921 | Nichols | 83/552 |
| 1,428,174 | 9/1922 | Luther | 83/125 |
| 2,589,849 | 3/1952 | Oetiker | 83/125 |
| 2,808,108 | 10/1957 | Pellegrino | 279/76 |
| 3,073,199 | 1/1963 | Yerkes | 30/358 |
| 3,111,053 | 11/1963 | Svensson | 83/125 |
| 3,230,812 | 1/1966 | Pucci et al. | 83/588 |
| 4,267,753 | 5/1981 | Bennett | 83/125 |
| 4,774,865 | 10/1988 | Wallis | 83/123 |
| 4,947,719 | 8/1990 | Whistler | 83/588 |
| 5,067,242 | 11/1991 | Singer | 30/364 |

FOREIGN PATENT DOCUMENTS

| | | | |
|---|---|---|---|
| 0566660 | 7/1977 | U.S.S.R. | 83/128 |
| 0597470 | 3/1978 | U.S.S.R. | 83/128 |

*Primary Examiner*—Rinaldi I. Rada
*Assistant Examiner*—Boyer Ashley
*Attorney, Agent, or Firm*—Morton J. Rosenberg; David I. Klein; Jun Y. Lee

[57] ABSTRACT

A shape cutting apparatus is provided having a lower mold body that can cut characteristic openings within the outer shape of sticker whose outer contour is cut by an upper mold body. When the outer shape of the sticker is cut, the inner characteristic openings are also cut at the same time. A protrude-out device that pushes out the finished sticker has a contour that is the same as the finished sticker.

2 Claims, 3 Drawing Sheets

APPARATUS FOR SHAPE CUTTING

BACKGROUND OF THE INVENTION

1. Field of the Invention

The invention is directed to an apparatus for cutting out shapes, especially for cutting out stickers for children. In particular, this apparatus can not only cut out the outer shape, but also characteristic openings within the perimeter of the outer shape. Therefore, children's stickers become more interesting and attractive.

2. Prior Art

Presently, use of shape cutting devices in the market are convenient and fun. A piece of colored paper is positioned between the upper mold body and the lower mold body of the shape cutting device. Then, the button on top of the device is pushed down and a sticker is thereby cut. However, only the outer shape of sticker can be cut by such devices. Children easily become tired of the device because the stickers are not interesting and attractive enough. Referring to the issue of No. 81203592 of the Patent Bulletin of Taiwan, Republic of China, the apparatus disclosed therein can only cut the outer shape of children's stickers, but not the characteristic openings within the outer shape.

SUMMARY OF THE INVENTION

The apparatus for shape cutting has a lower mold body that can cut the characteristic openings, such as eyes or mouth, within the outer shape of a sticker. The lower mold body extends from the bottom wall of the lower opening of the lower base and the upper opening that is formed through the upper mold body is positioned with respect to the lower mold body. Therefore, when the outer shape of the sticker is cut, the inner characteristics can be cut at the same time. A protrude-out device that pushes out the finished sticker shares a shape in common with the lower opening and is located inside of the lower opening.

DESCRIPTION OF THE PREFERRED EMBODIMENTS

Figure 1:
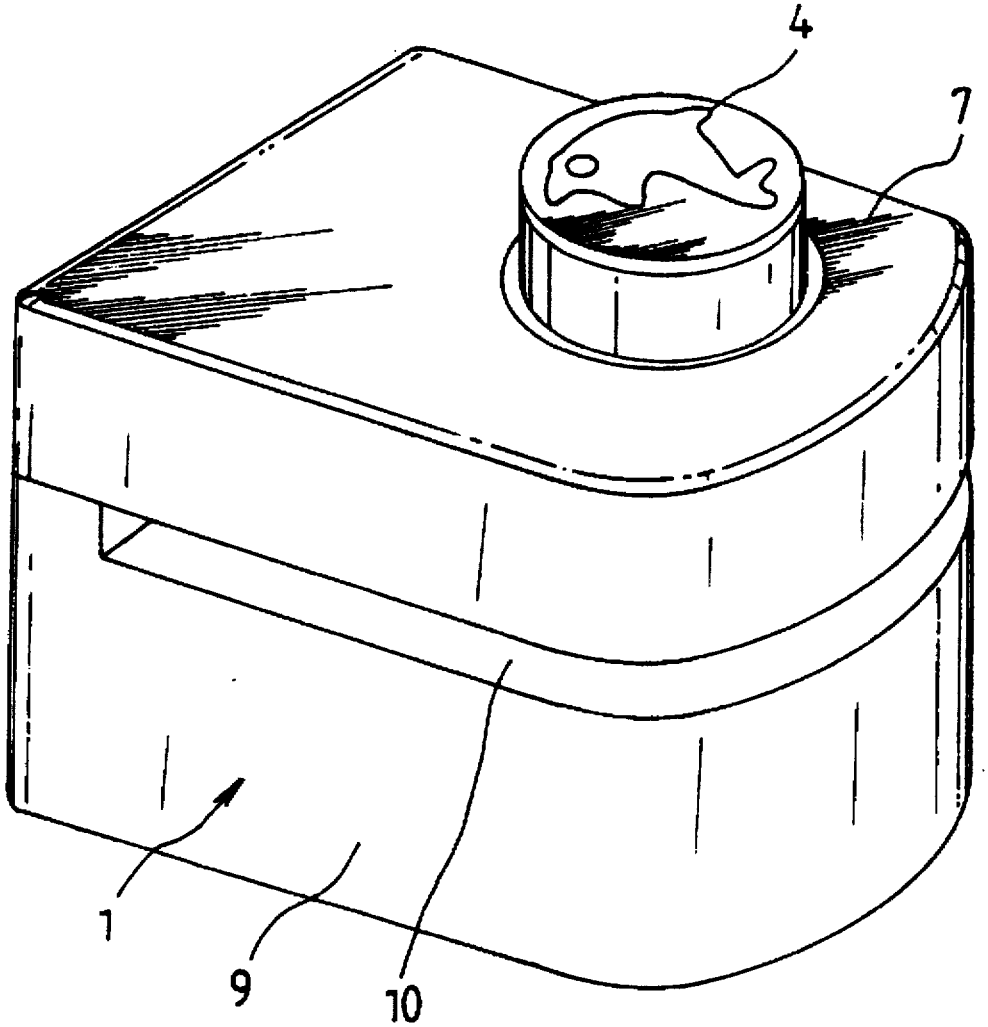
FIG. 1 is a perspective view of the present invention.
Figure 2:
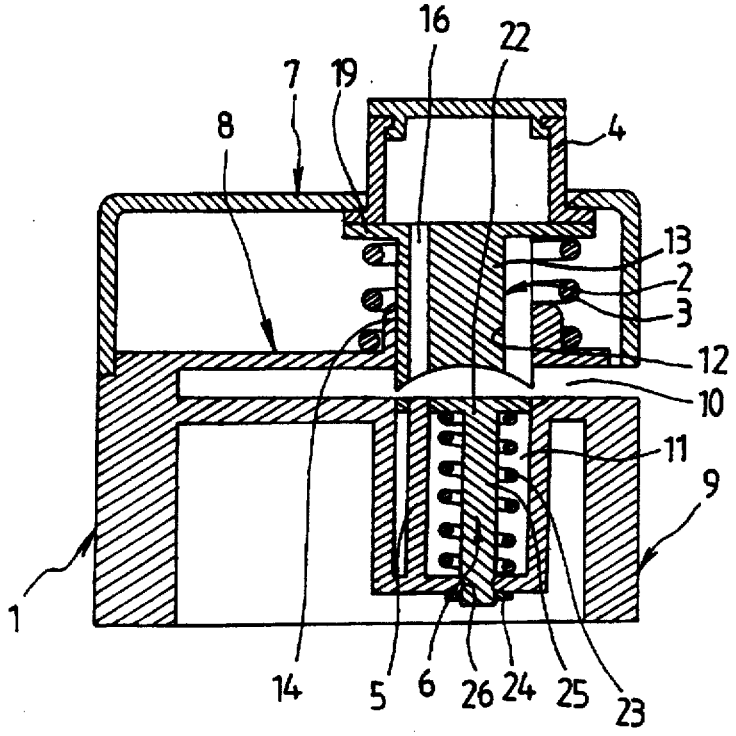
FIG. 2 is a cross-sectional view of the present invention.
Figure 3:
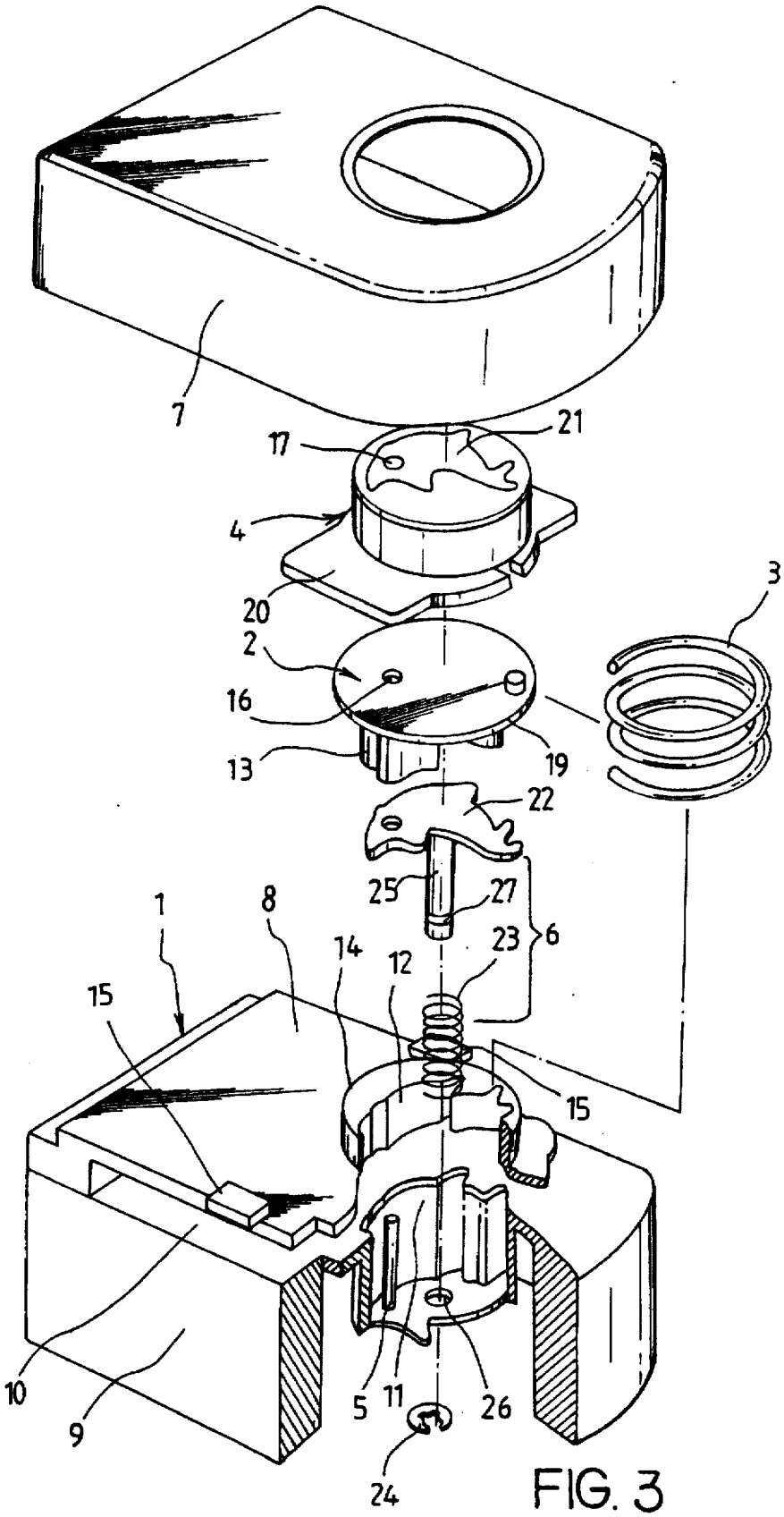
FIG. 3 is an exploded view, partially sectioned, of the present invention.

Referring to FIGS. 1, 2 and 3, there is shown, the base member 1, the upper mold body 2, the punching spring 3, the punching button 4, the lower mold body 5, the protrude-out device 6, and the cover 7. The base member 1, made of metal, includes an upper part 8 disposed in spaced parallel relationship with the lower base 9. The space 10 between the parallel upper part 8 and lower base 9 is provided for insert of the colored paper to be cut.

A lower opening 11 of the lower base 9 shares a common shape with the upper mold body 2. The protrude-out device 6 and the lower mold body 5 are disposed within the lower opening 11. The upper mold body 2 is forced downward to cooperate with the lower opening 11, to cut out a sticker having a shape in common with that of the lower opening 11 and the lower mold body 5. The guide opening 12 of the upper part, located with respect to the lower opening 11, shares in common the shape of the lower opening 11 and is used to insert and guide the mold body 13 into the right position in order to match the lower opening 11 with the lower mold body 13. In order to guide the mold body 13, the wall of the guide opening can extend upward within a cylindrically shaped protruding portion 14. Such protruding portion 14 can hold the bottom portion of the cylinder-shaped punching spring in position.

Figure 4:
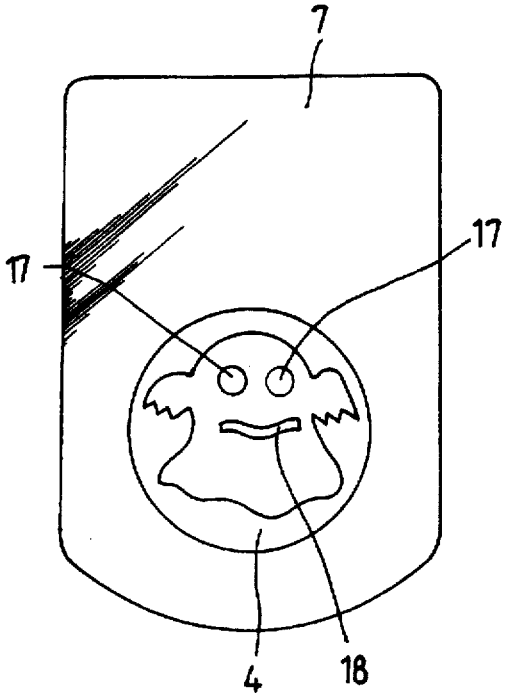
FIGS. 4 and 5 are plan views of embodiments of the present invention.
Figure 5:
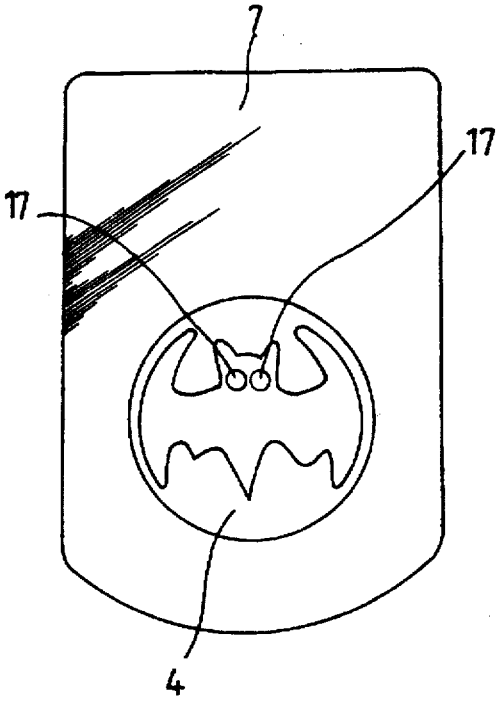

Somewhere around the upper part 8 of the base member 1 there is installed a block 15 to secure the cover 7 in position. The mold body 13 of the upper mold body 2 has a shape in common with the lower opening 11 and the guide opening 12. The upper opening 16 that is formed through the upper mold body 2 shares a shape in common with the lower mold body 5. When the user pushes down the punching button 4, the punching slide 19, located at the upper part of the upper mold body 2, is pressed downward against an upward force by the punching spring 3, disposed between the upper part 8 and the punching slide 19. The outer shape of the sticker and the characteristics within the outer shape can be cut at the same time, as shown in FIGS. 4 and 5.

The scrap paper, punched out by the lower mold body, is displaced from the upper opening 16 to the top of the punching slide 19. The other functions of the punching slide 19 are to receive the pressure from the punching button 4 and to make the mold body 13 automatically retract from the lower opening and positioned inside of the guide opening 12 by the punching spring 3. The length of the punching spring 3 matches to the length of the mold body 13, and keeps the mold body 13 in position within the guide opening 12.

The punching button 4 is a circular cover with two ears 20 disposed around the bottom of the punching button. The distance between the two ears 20 is equivalent to the width dimension of the inner part of the cover 5. Therefore, the punching button would not turn when the user pushes it down. There is indicia 21, indicating the appearance of the entire sticker, on the top of the punching button 4. Thus, the users can easily choose whatever they prefer by recognition of the indicia 21 on the top of the punching button 4.

Referring to the FIGS. 2 and 3, the lower mold body 5 is disposed perpendicular to the bottom wall of the lower opening 11 and affixed thereto. The lower opening 11 is made to exactly coincide with the mold body 13. The lower mold body 5 is affixed in the position where the characteristic opening, such as an eye or a mouth, is supposed to be. The upper opening 16 of the mold body 13 is disposed in a position that corresponds to the location of the lower mold body 5. When the upper opening 16 is being pushed downward with the mold body 13 and touched to the top of the lower mold body 5, an opening representing an eye, mouth or other characteristic of the sticker is cut.

Referring further to FIGS. 2 and 3, the protrude-out device 6 is designed to push out the finished sticker from the lower opening 11. The protrude-out device 6 includes a top cover 22 with a post 25 extending from a lower side thereof, a spring 23 and C-shaped spring 24. The top cover 22 shares a shape in common with the lower opening 11 and is disposed at the entrance to the lower opening 11. The top cover 22 has a hole in correspondence with the lower mold body 5, for passage of the lower mold body 5 therethrough. The post 25 of the protrude-out device 6 goes through the spring 23 and passes through a hole 26 formed through the bottom wall of the lower opening 11. The post 25 has ring-shaped groove 27 formed at its distal end for coupling with the C-shaped spring 24 after passing through the hole 26. Therefore, the protrude-out device 6 is affixed to the bottom wall of the lower opening 11.

When the upper mold body 2 is pushed downwardly by the punching button 4, it pushes the mold body 13 downward and cuts the paper disposed in the space 10 between the upper part 8 and the lower base 9. The mold body 13 pushes the top cover 22 downward and leaves the finished sticker on the top of the top cover 22. When the punching button 4 is released, the upper mold body 2 is displaced back to its original position by the punching springs. At the same time, the top cover 22 loses the pressure from the upper mold body 2. The spring 23 extends and pushes up the top cover 22 and the sticker on the top of the top cover 22 is displaced to the space 10. The cover 7 shares the common shape with the base member 1 and connects to the upper part 8 of the base member 1. The space 10 between the upper part 8 and the base 9 is for receipt of colored papers. The sticker that is cut from the colored paper has the same contour as the indicia 21 on the top of the punching button 4. Referring to FIGS. 4 and 5, besides a single eye, other characteristic openings can be cut by the same method, such as by increasing the number of lower mold bodies 5 and upper openings 16 to form eye openings 17 and mouth opening 18.

I claim:

1. An apparatus for shape cutting comprising:

a lower base having an upper wall with an opening formed therein, said opening having a predetermined contour, said lower base having a bottom wall disposed in spaced parallel relationship with respect to said upper wall and disposed in alignment with said opening;

an upper base portion disposed in spaced parallel overlaying relationship above said upper wall of said lower base for forming a gap therebetween into which a workplace is received, said upper base portion having a guide opening formed therethrough, said guide opening having said predetermined contour and being disposed in corresponding aligned relationship with said opening in said lower base upper wall;

a lower mold body coupled to said bottom wall and extending upwardly therefrom, said lower mold body having a predetermined cross-sectional contour;

an upper mold body displaceably disposed above said upper base portion and having opposing upper and lower end portions, said lower end portion having a cross-sectional contour corresponding to said predetermined contour and being disposed in said guide opening, said lower end portion having an opening formed therein disposed in aligned relationship with said lower mold body and having a contour corresponding to said predetermined cross-sectional contour of said lower mold body;

a punching spring disposed between said upper base portion and said upper end portion of said upper mold body for applying a bias force to said upper mold body; and, means for pushing out a cutout portion of a workpiece coupled to said bottom wall of said lower base, whereby the cutout portion of the workpiece is cut in said predetermined contour responsive to a downward displacement of said upper mold body and substantially simultaneously an aperture is cut in the cutout portion of the workplece having a contour corresponding to said predetermined cross-sectional contour.

2. The apparatus for shape cutting as recited in claim 1 where said pushing out means includes:

a top cover member having a contour corresponding to said predetermined contour and being displacably disposed in said opening in said lower base upper wall, said top cover member having a through hole formed therein disposed in aligned relationship with said lower mold body for passage of said lower mold body therethrough;

a spring disposed between a bottom surface of said top cover and said bottom wall of said lower base;

a post coupled to said bottom surface of said top cover member and extending through said spring, said post having a distal end extending through an aperture formed through said bottom wall of said lower base, said post having an annular groove formed therein adjacent said distal end thereof; and, a C-shaped spring engaged to said annular groove of said post.

* * * * *